US006523364B1

(12) United States Patent
Pader

(10) Patent No.: US 6,523,364 B1
(45) Date of Patent: Feb. 25, 2003

(54) WATER BOTTLE COOLING JACKET

(76) Inventor: A. Gregg Pader, 4574 Excelsior Rd., Mather, CA (US) 95655

( * ) Notice: Subject to any disclaimer, the term of this patent is extended or adjusted under 35 U.S.C. 154(b) by 0 days.

(21) Appl. No.: 10/160,789

(22) Filed: May 31, 2002

(51) Int. Cl.[7] ..... F17C 13/00; F25B 21/00

(52) U.S. Cl. ..... 62/457.9; 62/238.2; 62/267; 62/262

(58) Field of Search ..... 62/457.9, 238.2, 62/267

(56) References Cited

U.S. PATENT DOCUMENTS 4,549,410 A * 10/1985 Russell ..... 62/457
4,821,529 A * 4/1989 Maier ..... 62/239
5,009,083 A 4/1991 Spinos et al.
5,357,761 A 10/1994 Schauer
5,572,872 A * 11/1996 Hlavacek ..... 62/3.6
5,609,039 A 3/1997 Green et al.
5,653,124 A 8/1997 Weber
5,709,105 A * 1/1998 Palermo ..... 62/457.4
5,845,499 A 12/1998 Montesanto
5,845,501 A * 12/1998 Stonehouse et al. ..... 62/62
5,845,514 A * 12/1998 Clarke et al. ..... 62/373
5,941,090 A 8/1999 Knutson et al.
5,970,719 A * 10/1999 Merritt ..... 62/3.6
6,018,961 A 2/2000 Venture et al.
6,082,114 A * 7/2000 Leonoff ..... 62/3.64
6,119,461 A * 9/2000 Stevick et al. ..... 62/3.64
6,269,653 B1 * 8/2001 Katusa ..... 62/457.9

* cited by examiner

*Primary Examiner*—William C. Doerrler
*Assistant Examiner*—Mark Shulman
(74) *Attorney, Agent, or Firm*—John D. Gugliotta

(57) ABSTRACT

An improved portable cooling device for a standard water bottle, specifically a standard water bottle is placed within a cooling jacket and secured in place using a zipper or similar attachment mechanism. The cooling jacket is comprised of a cooling agent located within inner cooling tubes in the cooling jacket. The inner cooling agent is circulated through the tubes by a motor-driven compressor. The motor-driven compressor is connected to a standard automobile cigarette lighter for power.

5 Claims, 2 Drawing Sheets

WATER BOTTLE COOLING JACKET

RELATED APPLICATIONS

The present invention was first described in Disclosure Document Registration 499,888 filed on Sep. 14, 2001 under 35 U.S.C. §122 and 37 C.F.R. §1.14, but not yet returned. There are no previously filed, nor currently any co-pending applications, anywhere in the world.

BACKGROUND OF THE INVENTION

1. Field of the Invention

The present invention relates generally to portable cooling devices and, more particularly, to a portable chilling jacket adapted for single-bottle use and powered via the electrical system of an automobile.

2. Description of the Related Art

Nothing is more refreshing or healthy on a hot day than an ice-cold glass or bottle of water. However, unless one is located near a refrigerator or an endless supply of ice, such enjoyment usually only lasts a few minutes before the bottle begins to warm up. This is especially a problem for those who spend a good deal of time in a motor vehicle such as a car or truck during the day. Not only are refrigerators and ice difficult to come by in such an environment, the elevated temperatures found inside motor vehicles, especially on a sunny day, make the water warmer quicker. This forces one to continually stop at rest stops, convenience stores, gas stations and the like to purchase a new cold bottle, even if the old one is not finished. This obviously has a negative impact on cost and time.

A search of the prior art did not disclose any patents that read directly on the claims of the instant invention; however, the following references were considered related.

U.S. Pat. No. 6,018,961, issued in the name of Darrell M. Venture and Darrell M. Venture, Jr., describes a coolant apparatus and method for quickly chilling an article.

U.S. Pat. No. 5,941,090, issued in the name of Paul L. Knutson, et al, describes a thermal jacket for pressurized containers.

U.S. Pat. No. 5,845,499, issued in the name of Michael Montesanto, describes a beverage insulating sleeve with a chilling chamber.

U.S. Pat. No. 5,653,124, issued in the name of Martin Weber, describes a refrigerated insulated stein.

U.S. Pat. No. 5,609,039, issued in the name of Dennis E. Green and Harry Collier, describes a cooling cartridge for drinking bottles.

U.S. Pat. No. 5,357,761, issued in the name of Curtis S. Schauer, describes a universal thermal insert for beverage containers.

U.S. Pat. No. 5,009,083, issued in the name of Frank T. Spinos, et al, describes a beverage cooler.

Consequently, a need has developed for a means by which bottled water can be kept at a constant chilled temperature while in a motor vehicle in a manner which is quick, easy and effective.

SUMMARY OF THE INVENTION

It is therefore an object of the present invention to provide an improved portable cooling device.

It is a feature of the present invention to provide an improved portable chilling jacket adapted for single-bottle use and powered via the electrical system of an automobile.

Briefly described according to one embodiment of the present invention, a water bottle cooling jacket is provided as a self contained cooling system for personal sized bottles of water. Appearing on the outside like a holder for clear plastic water bottles, a small motor-driven compressor is provided at the bottom of the jacket, which is supplied 12-volt direct current power from a motor vehicle electrical system. The power is provided by a power cord with a cigarette lighter plug on the opposite end. The compressor circulates chilled Freon or similar refrigerant around the case of the jacket in a series of tubes. The tubes then directly chill the water in the water bottle. The system is ideal for those traveling by motor vehicle who wish to maintain water or any similar beverage at a chilled temperature.

The use of the present invention provides a means to enjoy cold water or similar beverage without the aggravation of the liquid warming after a short period of time.

BRIEF DESCRIPTION OF THE DRAWINGS

The advantage and features of the present invention will become better understood with reference to the following more detailed description and claims taken in conjunction with the accompanying drawings, in which like elements are identified with like symbols, and which:

DESCRIPTION OF THE PREFERRED EMBODIMENTS

1. Detailed Description of the Figures

Figure 1:
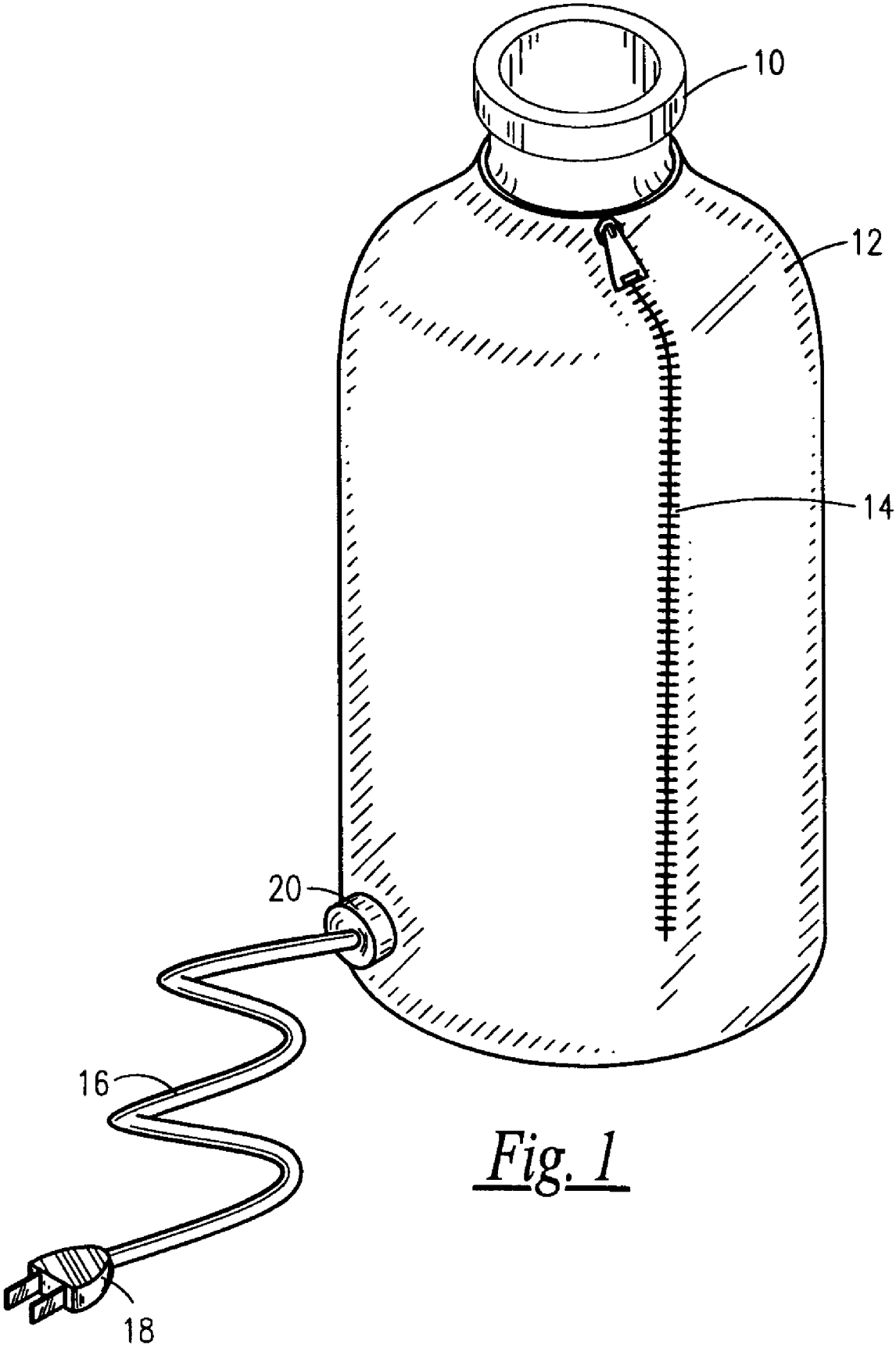
FIG. 1 is a perspective view of a water bottle cooling device.
Figure 2:
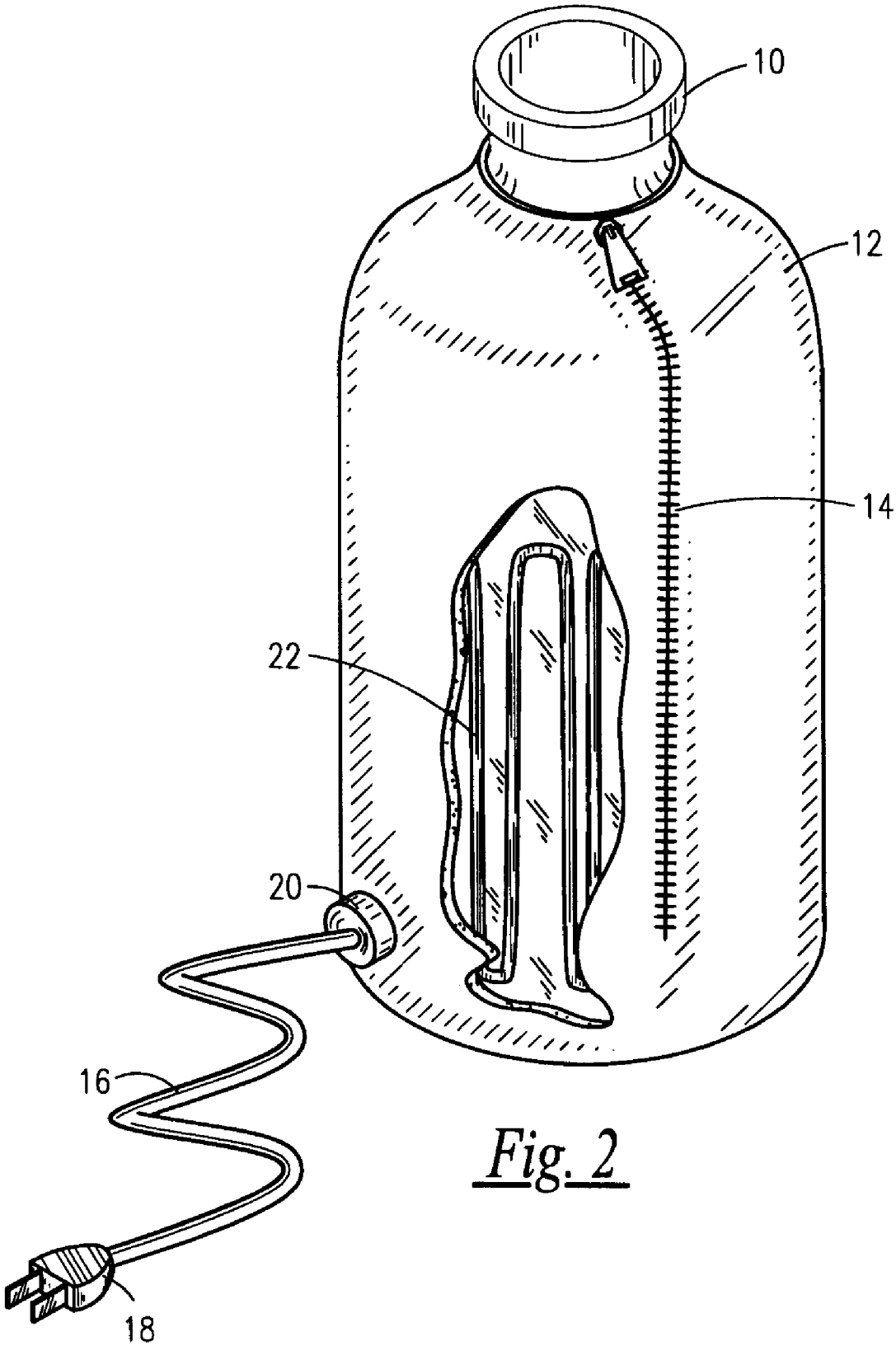
FIG. 2 is a cross sectional view of the water bottle cooling device.

FIG. 1, illustrates a standard water bottle chilling in a water bottle cooling jacket device of the instant invention. The water bottle cooling jacket device comprises a cooling jacket 12 as shown in FIG. 1. The cooling jacket is comprised of a cooling agent within inner cooling tubes 22. These inner cooling tubes 22 are located in the cooling jacket 12 and a small motor-driven compressor 20 at the bottom of the cooling jacket 12 as shown in FIG. 2. The water bottle cooling device is connected to a cigarette lighter 18 by a power cord 16 to the said motor-driven compressor 20 as shown in FIG. 1. The opposite ends of the cooling jacket 12 are attached using an attachment mechanism 14 as shown in FIG. 1.

2. Operation of the Preferred Embodiment

In operation, the present invention the user would do the following: First, place the cooling jacket 12 around a standard water bottle 10. Second, attach the opposite ends of the cooling jacket together using the attachment mechanism 14. Third, place the cigarette lighter 18 into a standard automobile cigarette lighter, thus allowing the motor-driven compressor 20 to circulate a cooling agent within the inner cooling tubes 20.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be limited only by the following claims.

What is claimed is:

1. A cooling device comprising:

a portable cooling jacket, said portable cooling jacket of sufficient size to accommodate a single beverage container;

an attachment mechanism, said attachment mechanism substantially enclosing said beverage container within said portable cooling jacket;

a reticulated cooling tube, said cooling tube housed within said portable cooling jacket;

a cooling agent, said cooling agent circulated through said cooling tube;

a motor-driven compressor, said compressor circulating said cooling agent through said cooling tube; and a power source for said cooling jacket, said power source providing electrical current from an electrical outlet to said compressor.

2. The cooling device of claim 1, wherein said portable cooling jacket comprises:

a substantially vertical sidewall; and a base, said base substantially perpendicular to said sidewall, said base providing support for said beverage container.

3. The cooling device of claim 2, wherein said cooling agent comprises FREON™.

4. The cooling device of claim 1, wherein said attachment mechanism comprises a zipper.

5. The cooling device of claim 1, wherein said power source further comprises a cigarette lighter adapter, said adapter electrically coupling said power source to a 12 volt cigarette lighter of an automobile, thereby providing beverage cooling to said beverage container during automobile transportation.

* * * * *